United States Patent [19]

Davis

[11] 4,161,298

[45] Jul. 17, 1979

[54] WINDING MACHINE

[76] Inventor: Daryl Davis, 3221 Tanglewood Trail, Fort Worth, Tex. 76109

[21] Appl. No.: 895,509

[22] Filed: Apr. 11, 1978

[51] Int. Cl.[2] ..... B65H 17/02

[52] U.S. Cl. ..... 242/67.1 R; 242/60

[58] Field of Search ..... 242/60, 67.1 R, 68.3, 242/74, 74.1

[56] References Cited

U.S. PATENT DOCUMENTS

| | | | |
|---|---|---|---|
| 1,951,062 | 3/1934 | Peet | 242/74.1 |
| 2,178,346 | 10/1939 | Mulch | 242/74.1 |
| 3,113,742 | 12/1963 | Bevan | 242/67.1 R |
| 3,385,535 | 5/1968 | Dodsworth | 242/67.1 R |
| 3,395,870 | 8/1968 | Klinger | 242/67.1 R X |

*Primary Examiner*—Edward J. McCarthy

*Attorney, Agent, or Firm*—Clarence A. O'Brien; Harvey B. Jacobson

[57] ABSTRACT

A winding machine for forming rolls of tape used for wrapping the legs of horses, and the like includes a shaft mountable by a collar to the drive shaft of an electric motor, and the like, for rotation by the drive shaft, and having associated with the shaft a guide strip also mounted on the collar and arranged extending substantially parallel, although spaced from, the shaft in order to form a gap which receives the end of a tape wrapped around the shaft and guide strip. A disc is slidably mounted on the shaft and guide strip for forming an end guide for the roll being formed, as well as facilitating removal of a completed roll from the shaft and guide strip.

8 Claims, 5 Drawing Figures

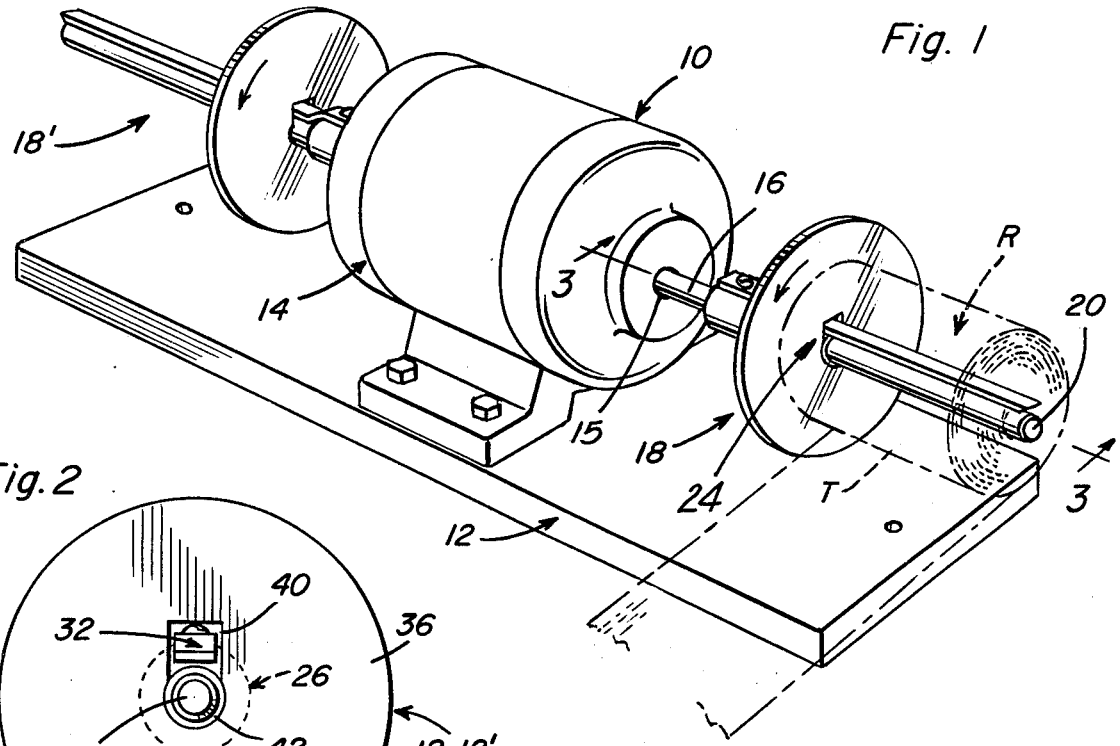
Fig. 1
Fig. 2
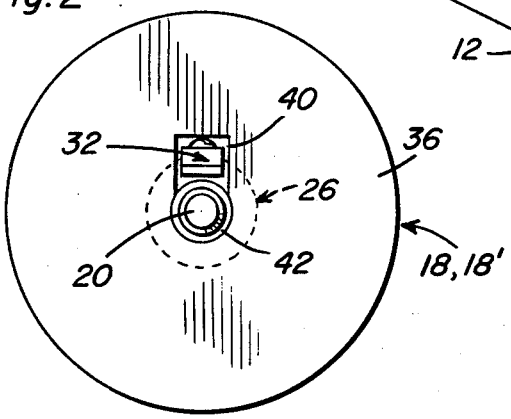
Fig. 3
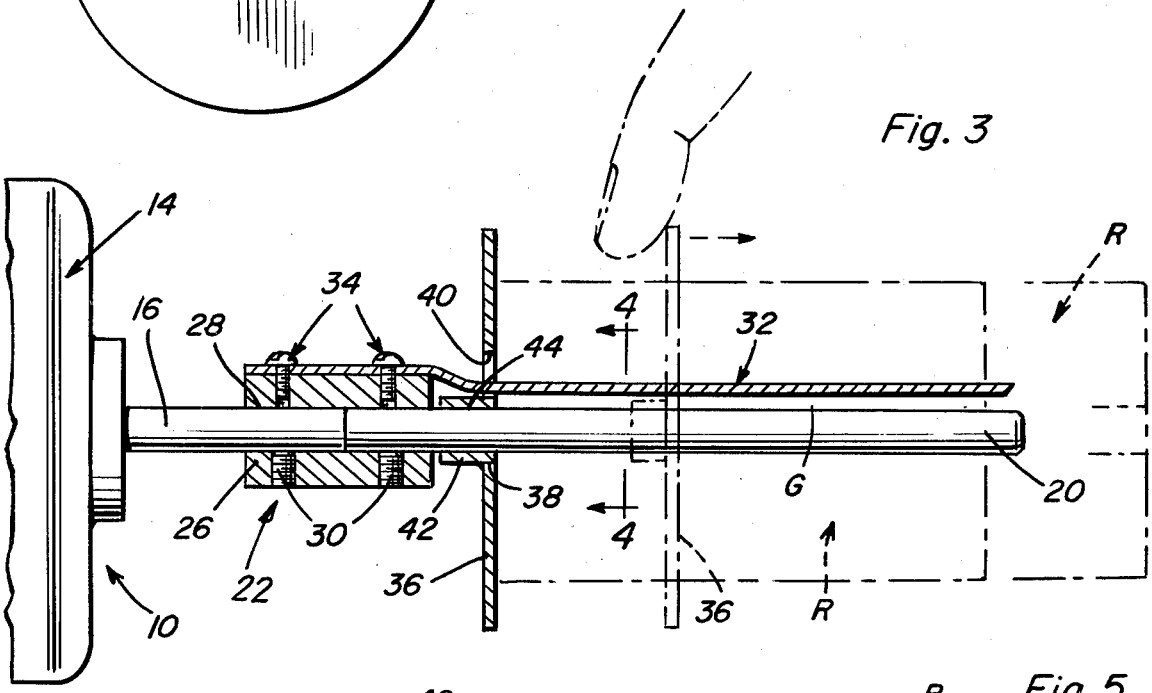
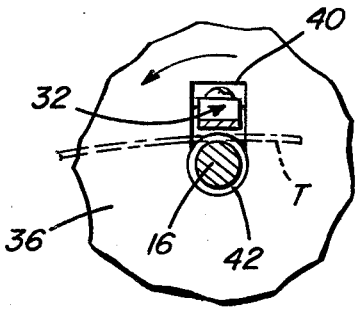
Fig. 4
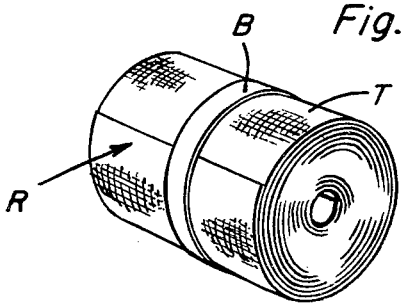
Fig. 5

WINDING MACHINE

BACKGROUND OF THE INVENTION

1. Field of the Invention

This invention relates generally to a winding machine, and particularly to a device for facilitating the winding into rolls of tape such as that used for wrapping the legs of horses.

2. Description of the Prior Art

Race horses, polo ponies, and the like require leg wrappings consisting of a long length of material formed into a tape. A problem arises as to the manner in which to wind this tape when same is not in use so as to facilitate storage of the tape, the usual manual winding methods being very time consuming.

U.S. Pat. No. 3,653,602, issued Apr. 4, 1972 to C. M. Harrington, discloses an electric angle wrapping apparatus having a notched shaft which receives an end of the tape for wrapping same, with the tape being guided by a pair of spaced apart guides mounted on a rod fixed in parallel, spaced relation with respect to the shaft in order to cause the wrap to roll evenly at the edges.

U.S. Pat. Nos. 437,553, issued Sept. 30, 1890 to C. L. Beers, and 3,516,618, issued June 23, 1970 to R. F. Reinke, disclose a bandage winding device using grooved or slotted rotating shafts to retain an end of a bandage strip so as to permit rotation of the shaft to wind the bandage into a roll. Further, U.S. Pat. Nos. 458,864, issued Sept. 1, 1891 to M. D. Tibbetts, and 1,359,021, issued Nov. 16, 1920 to T. A. Blair, disclose additional examples of machines instructed for winding strip bandages into rolls.

SUMMARY OF THE INVENTION

It is an object of the present invention to provide a tape winding machine of simple construction, yet capable of consistently winding tape into rolls even at the edges.

Another object of the present invention is to provide a winding machine from which wound rolls are easily removed.

It is another object of the present invention to provide a winding machine which can be used in pairs with a conventional electric motor having a shaft which extends in opposite directions from the motor housing.

These and other objects of the present invention are achieved by providing a winding machine having; a shaft; a connector attached to the shaft for coupling the shaft to an associated drive shaft of an electric motor, and the like, for rotation of the shaft by the drive shaft; and a guide assembly forming a gap in cooperation with the shaft, which gap receives a length of tape for permitting the tape to be wound on the shaft as the shaft rotates.

The connector preferably includes a cylindrical collar provided with a through bore arranged for receiving the associated drive shaft, the shaft being partially inserted into the bore, and clamps provided on the collar and engaging the shaft engageable with the drive shaft for holding the shaft on the collar and the collar on the drive shaft.

The shaft advantageously extends longitudinally from the collar, with the guide assembly including a guide strip affixed to the collar for rotation therewith and arranged extending longitudinally substantially parallel to and generally co-extensive with the shaft, but spaced therefrom, for forming the gap. The guide assembly preferably further includes a planar guide member provided an opening arranged for receiving the shaft, and with a window arranged for receiving the guide strip, the guide member being slidably disposed on the shaft and arranged for forming an end guide for, and facilitating removal of, a roll wrapped on the machine.

These together with other objects and advantages which will become subsequently apparent reside in the details of construction and operation as more fully hereinafter described and claimed, reference being had to the accompanying drawing forming a part hereof, wherein like numerals refer to like parts throughout.

BRIEF DESCRIPTION OF THE DRAWINGS

FIG. 1 is a perspective view showing winding machines according to the present invention mounted a dual shaft electric motor, and the like.

FIG. 2 is an enlarged, end view of one of the winding machines seen in FIG. 1.

FIG. 3 is an enlarged, fragmentary, sectional view taken generally along the line 3—3 of FIG. 1.

FIG. 4 is a fragmentary, sectional view taken generally along the line 4—4 of FIG. 3.

FIG. 5 is a perspective view showing a roll of tape wound with a winding machine according to the present invention.

DESCRIPTION OF THE PREFERRED EMBODIMENTS

Referring now more particularly to FIG. 1 of the drawing, an electric motor 10 of conventional construction is illustrated as mounted on a support 12, and includes a housing 14 having spaced end portions 15 from which extend in opposite directions the ends of a drive shaft 16. Mounted on each of the ends of drive shaft 16 are winding machines 18, 18' according to the present invention. As indicated by the direction arrows in FIG. 1, these winding machines 18, 18', although being identical in construction, can be used in either direction of rotation in order to wind a tape T in a roll R.

Referring now more particularly to FIGS. 2 through 4 of the drawings, each of the winding machines 18, 18' includes a longitudinally extending shaft 20 and a connector 22 attached to shaft 20 for coupling shaft 20 to the associated end of drive shaft 16 both for support of shaft 20 on motor 10 and for rotation of shaft 20 by drive shaft 16. A guide assembly 24 forms in cooperation with shaft 20 a gap G which receives a length of tape T for winding tape T onto shaft 20 as shaft 20 is rotated by the drive shaft 16.

Connector 22 includes a cylindrical collar 26 provided with a through bore 28 arranged for receiving the associated end of drive shaft 16, the shaft 20 being partially inserted into bore 28 as well, and clamps in the form of set screws 30 provided on collar 26 and engaging with shaft 16 and 20 for holding shaft 16 and 20 within the bore 28 of collar 26 and mounting shaft 20 onto shaft 16 for rotation of the former by rotation of the latter.

Shaft 20 extends longitudinally from collar 26 in the direction away from shaft 16, with the guide assembly 24 including a guide strip 32 affixed to collar 26 as by the illustrated screws 34 for rotation with collar 26, the guide strip 32 being arranged extending longitudinally substantially parallel to, but spaced from and generally co-extensive with shaft 20 so as to form the aforementioned gap G.

Guide assembly 24 further includes a planar guide member 36 in the form of the illustrated disc which is provided with a central opening 38 arranged for receiving shaft 16. Member 36 is also provided with a window 40 which may or may not communicate with opening 38, arranged for receiving guide strip 32. In this manner, guide member 36 can be slidably disposed on shaft 16, and guide strip 32, and be arranged for forming an end guide for and facilitating removal of a row R wrapped on the machine 18, 18'.

Preferably, a bushing 42 having a through hole 44 dimensioned to slidable mate with the periphery of shaft 20 is inserted into the opening 38 provided in guide member 36 for assuring that guide member 36 will slide relative to shaft 20 in a smooth manner and without undesirable wobble, and the like.

As can be appreciated from the drawings, once an end of a tape T is inserted into gap G and motor 10 started into rotation, the tape T will be wound into a roll R against the guide member 36 so as to create a roll having even ends. Once the tape is wound onto the shaft 20, and guide strip 32, removal of the resulting roll R can be easily accomplished by sliding of the guide member 36 away from collar 26 as is illustrated in broken lines in FIG. 3 and once removed from the associated machine 18, 18', the roll R can be secured as by an elastic band B, and the like, as illustrated in FIG. 5.

It also will be appreciated that shaft 16 could be the shaft of a conventional gear reduction box of an electric motor, if desired, with a, for example, 10-stage electronic speed controller, known per se, controlling the motor.

As can be readily understood from the above description and from the drawings, a winding machine according to the present invention permits tape such as used for wrapping the legs of horses to be wound into compact rolls for facilitating storage in a simple and easy, yet rapid and efficient manner, thus eliminating a great deal of time normally spent in winding such rolls by hand, and other crude methods.

The foregoing is considered as illustrative only of the principles of the invention. Further, since numerous modifications and changes will readily occur to those skilled in the art, and operation shown and described, and accordingly all suitable modifications and equivalents may be resorted to, falling within the scope of the invention.

What is claimed as new is as follows:

1. A winding machine, comprising, in combination:

(a) a shaft;

(b) connector means attached to the shaft for coupling the shaft to an associated drive shaft for rotation by the drive shaft, and (c) guide means engageable with a tape being wound for guiding the tape as the shaft is rotated and causing the tape to wind on the shaft, the connector means including a cylindrical collar provided with a through bore arranged for receiving the associated drive shaft, the shaft of the winding machine being partially inserted into the bore as well, and clamp means provided on the collar and engaging the shaft and engageable with the drive shaft for holding the shaft in the collar and the collar on the drive shaft.

2. A structure as defined in claim 1, wherein the shaft extends longitudinally from the collar, with the guide means including a guide strip affixed to the collar for rotation therewith and arranged extending longitudinally substantially parallel to, spaced from, and generally co-extensive with the shaft for forming a longitudinally extending gap arranged for receiving an end of a tape to be wound.

3. A structure as defined in claim 2, wherein the guide means further includes a planar guide member provided with an opening arranged for receiving the shaft, and with a window arranged for receiving the guide strip, the guide member being slidably disposed on the shaft and arranged for forming an end guide and for facilitating removal of a roll of tape wrapped on the machine.

4. A winding machine, comprising, in combination:

(a) a shaft;

(b) connector means attached to the shaft for coupling the shaft to an associated drive shaft for rotation by the drive shaft; and (c) guide means engageable with a tape being wound for guiding the tape as the shaft is rotated and causing the tape to wind on the shaft, wherein the shaft extends longitudinally from the connector means, with the guide means including a guide strip affixed to the connector means for rotation therewith and arranged extending longitudinally substantially parallel to, spaced from and generally co-extensive with the shaft for forming a gap between the guide strip and shaft, which gap is arranged for receiving end of a tape to be wound, the guide means further including a planar guide member provided with an opening arrangement receiving the shaft, with a window arranged for receiving the guide strip, the guide member being slidably disposed on the shaft and arranged for forming an end guide for facilitating removal of a roll wrapped on the machine.

5. In combination with an electric motor including a housing and a drive shaft extending from the housing, a winding machine mounted on the drive shaft, the winding machine comprising, in combination:

(a) a shaft;

(b) connector means attached to the shaft and to the drive shaft for coupling the shaft to the drive shaft for rotation of the shaft by the drive shaft; and (c) guide means for guidingly engaging a tape to be wound on the machine and causing the tape to be wound about the shaft as the shaft is rotated by the drive shaft, the connector means including a cylindrical collar provided with a through bore arranged for receiving the drive shaft, the shaft of the winding machine being partially inserted into the bore as well, and clamp means provided on the collar and engaging the shaft and drive shaft for holding the shaft on the collar and the collar on the drive shaft.

6. A structure as defined in claim 5, wherein the shaft extends longitudinally from the collar, with the guide means including a guide strip affixed to the collar for rotation therewith and arranged extending longitudinally substantially parallel to, spaced from, and generally co-extensive with the shaft for forming a longitudinally extending gap arranged for receiving an end of a tape to be wound.

7. A structure as defined in claim 6, wherein the guide means further includes a planar guide member provided with an opening arranged for receiving the shaft, and with a window arranged for receiving the guide strip, the guide member being slidably disposed on the shaft and arranged for forming an end guide and for facilitating removal of a roll of tape wrapped on the machine.

8. In combination with an electric motor including a housing and a drive shaft extending from the housing, a winding machine mounted on the drive shaft, the winding machine comprising, in combination:

(a) a shaft;

(b) connector means attached to the shaft and to the drive shaft for coupling the shaft to the drive shaft for rotation of the shaft by the drive shaft; and (c) guide means for guidingly engaging a tape to be wound on the machine and causing the tape to be wound about the shaft as the shaft is rotated by the drive shaft, the drive of the motor extending from the housing of the motor in opposite directions so as to form a dual drive shaft, wherein the winding machine is one of a pair of winding machines each constructed in an identical manner and mounted on a respective one of the projecting ends of the drive shaft.

* * * * *